United States Patent [19]

Fuller

[11] 3,961,591

[45] June 8, 1976

[54] DEFLECTOR RUDDERS

[76] Inventor: Ronald George Fuller, P.O. Box 337, Hudson Heights, Quebec JOP IJO, Canada

[22] Filed: Aug. 1, 1974

[21] Appl. No.: 494,531

[52] U.S. Cl. ..... 114/166; 115/12 R

[51] Int. Cl.[2] ..... B63H 25/06

[58] Field of Search ..... 115/12 R, 12 A, 42; 114/151, 166, 167, 163

[56] References Cited

UNITED STATES PATENTS

| | | | |
|---|---|---|---|
| 1,344,518 | 6/1920 | Rees | 115/42 |
| 2,996,031 | 8/1961 | Easter | 115/42 |
| 3,001,502 | 9/1961 | Stoker | 114/167 |
| 3,181,492 | 5/1965 | Hockett | 114/167 |
| 3,457,891 | 7/1969 | Clark et al. | 114/166 |

*Primary Examiner*—Trygve M. Blix
*Assistant Examiner*—Charles E. Frankfort

[57] ABSTRACT

A propeller nozzle or duct in which the walls thereof terminate in two or more planes inclined symmetrically about an axis normal to the nozzle or duct centerline with one or more deflecter rudders pivotedly mounted across the opening so formed such that by swinging the rudder(s) one half of the exit area may be closed and the propeller race diverted through the remaining open area under the guidance of the rudder(s) upon which the race reacts to develop a steering force. The turning capabilities of a fixed nozzle or duct are thereby improved whilst wetted area may be reduced and propulsive efficiency increased by recovery of rotational energy otherwise lost to the wake. When used in conjunction with a pivoted steering nozzle a reverse thrust may be developed.

7 Claims, 8 Drawing Figures

DEFLECTOR RUDDERS

BACKGROUND TO THE INVENTION

This invention relates to improvements in moveable deflector rudders associated with propeller nozzles or ducts through which a liquid is accelerated for propulsion purposes.

The art discloses that the wetted surface area of such deflector rudders may be reduced when acted upon by the high velocity discharge from such a nozzle or duct without impairing the effectiveness of directional control, thereby reducing frictional losses and improving efficiency.

A plurality of such deflector rudders may be mounted vertically on a common transverse axis parallel to the plane end face of a nozzle or duct exit when they are commonly known as shutter rudders. The art discloses the use of such rudders in association with nozzles characterised by entry and exit terminations each comprising a single plane normal to the duct axis with rudders pivoted on a common axis parallel to the exit termination of the nozzle such that the propeller race divides to pass either side of said rudders thereby developing a pressure differential to provide a steering force.

Prior art also discloses the use of pivoted steering nozzles capable of rotation about a vertical axis whereby the nozzle discharge may be diverted to port or starboard as required to develop a steering force with, or without, the use of fixed or moveable vanes mounted on the nozzle.

Fixed nozzles with shutter rudders as known in the art are claimed to develop helm angles up to a maximum of 60° port or starboard by the use of three or more such rudders. It is a purpose of the present invention to so harness the discharge from a fixed nozzle or duct to develop helm angles to 90° and when used with a pivoted steering nozzle to have a capability of developing a reverse thrust.

The invention may also be applied to the leading termination of a nozzle or duct to improve directional control when going astern.

The following description is confined to two embodiments which typify the principles applicable to this invention, but it is to be understood that the invention is capable of modification and change and includes other details of construction without departing from the scope thereof.

DRAWING

In the accompanying drawing which illustrates two typical marine embodiments of this invention:

Figure 1:
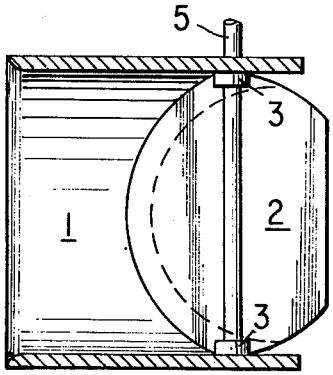
FIG. 1 shows a vertical sectional elevation.
Figure 2:
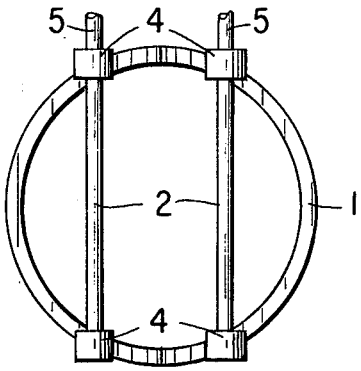
FIG. 2 shows an end elevation looking into the discharge end.
Figure 3:
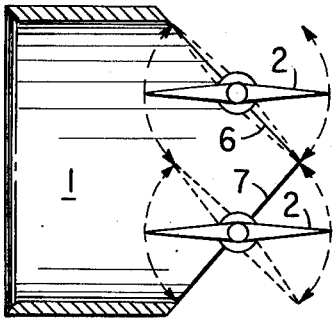
FIG. 3 shows a horizontal sectional plan view, all of a nozzle having two deflector rudders.
Figure 4:
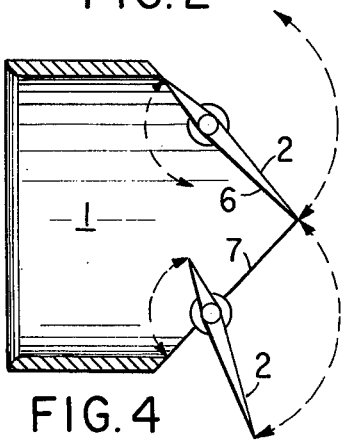
FIG. 4 shows a horizontal section plan view of a similar nozzle in which the deflector rudder on the open side of nozzle is brought into divergent relationship to the rudder in register with the closed side of the nozzle at maximum helm angle.
Figure 5:
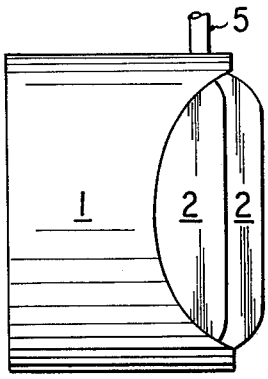
FIG. 5 shows a vertical side view elevation of a nozzle fitted with four deflector rudders and FIG. 6 is an end elevation of a similar installation in which the deflector rudders are each fitted with guide fins or straightening vanes.

Referring to the drawing, 1 is a nozzle supporting deflector rudders 2 by means of pintle bearings 3 carried on bosses 4. The several deflector rudders 2 in an installation are ganged together and caused to turn in unison by means of linkage (not shown) connecting with each deflector rudder 2, and which may be conveniently by means of spindle extension 5.

The walls of nozzle 1 terminate in two or more planes 6 and 7 symmetrically inclined to one another and intersecting an axis normal to the nozzle centerline.

Deflector rudders 2 are mounted on axes parallel to said planes, or in the case of a single deflector rudder 2 at a point where said parallel axes intersect the nozzle centerline.

Said deflector rudders are normally placed parallel to the nozzle centerline and to one another when proceeding on a straight course. For maximum helm the deflector rudders are turned simultaneously in the desired direction until the deflector rudder(s) on one side register with the exit from the nozzle on that side and divert the propeller race through the opening left by the deflector rudder(s) on the other side to develop a steering force. This force may be augmented by arranging the operating linkage to move the deflector rudders on said open side at increasing angles such that the deflector rudders are caused to take up a divergent position with respect to one another and the deflector rudder(s) on the substantially closed side of the nozzle.

Figure 8:
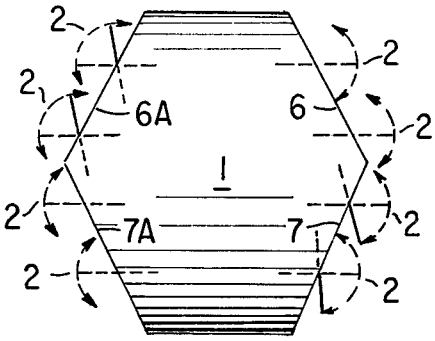
FIG. 8 is a plan view showing four deflector rudders of which the two on the open side are caused to take up divergent positions when the two on the other side are brought into register with the nozzle to obstract the flow.

Whilst deflector rudders are normally located at the after end of a nozzle, they can also be mounted at the leading end where they can serve as flanking rudders or be used to improve directional control when going astern see FIG. 8.

Figure 6:
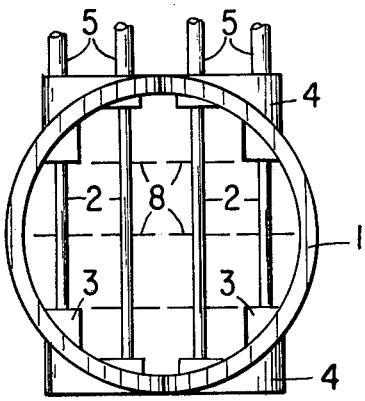
Figure 7:
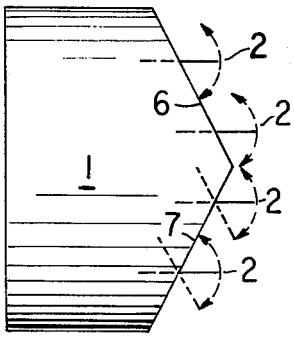
FIG. 7 is a plan view showing four parallel deflector rudders.

Deflector rudders may be provided with straightening guides 8 as shown in FIG. 6 such that they relate together to form guideways when in the mid position, thereby tending to straighten the wake and recover rotational energy otherwise lost to the wake. Such guides may be arranged to form helical or other passage configurations to this end.

Accordingly one embodiment takes the form of a propeller nozzle one or both ends of which have walls terminating in inclined planes symmetrical about an axis normal to the nozzle centerline, one or more deflector rudders pivotedly mounted parallel to said axis such that when part of said deflector rudder is brought into register with the inclined termination of one side of the nozzle, said inclined termination of one side of the nozzle is substantially closed off and the propeller race diverted through the remaining open side where it is caused to act upon the deflector rudder(s) interposed in the propeller race on said open side.

A second embodiment provides for the addition of fins to the sides of said deflector rudders such that they relate together to form straightening guides when the rudders are in the mid position.

What I claim is:

1. A propulsion and steering assembly for a marine vessel comprising a propeller operating within a nozzle, at least one end opening of said nozzle defined by inclined nozzle walls terminating in the form of inclined planes symmetrically intersecting at the nozzle centerline outboard of the intersection of said inclined planes with side walls of said nozzle thereby forming two inclined nozzle openings two balanced deflector rudders pivotally mounted across said two inclined nozzle openings and each said rudder having associated therewith a pivot axis lying vertically in one of said inclined planes, said deflector rudders profiled such that same may be turned within the nozzle profile to register with a respective one of said inclined nozzle openings to form a continuous solid barrier abutting to the nozzle side wall at one end whilst intersecting an axis normal to the nozzle centerline and parallel to each said rudder pivot axis at the other end, thereby to obstruct the passage of liquid through said one inclined nozzle opening and divert liquid through the other inclined nozzle opening remaining open on the other side of said nozzle there to act upon the other deflector rudder to enhance vessel steering.

2. An assembly according to claim 1 wherein more than two deflector rudders are used.

3. An assembly according to claim 1 wherein deflector rudders are used in multiples of two such that two or more may be turned to abut one to the other to form a continuous solid barrier abutting to the nozzle side wall at one end whilst intersecting an axis normal to the nozzle centerline and parallel to each said rudder pivot axis at the other end.

4. An assembly according to claim 1 wherein bearings supporting said deflector rudders are an assembly detachable from said nozzle.

5. An assembly according to claim 1 wherein adjacent deflector rudders are caused to diverge from one another in the course of turning to further enhance steering of the vessel.

6. An assembly according to claim 1 wherein guide vanes are mounted on the sides of each of said deflector rudders.

7. An assembly according to claim 1 wherein deflector rudders are mounted adjacent to both ends of said nozzle.

* * * * *